US010186808B2

(12) United States Patent
Akiba

(10) Patent No.: US 10,186,808 B2
(45) Date of Patent: Jan. 22, 2019

(54) SERVICE PLUG

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventor: Nobuyuki Akiba, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 15/738,168

(22) PCT Filed: Jun. 16, 2016

(86) PCT No.: PCT/JP2016/067880
§ 371 (c)(1),
(2) Date: Dec. 20, 2017

(87) PCT Pub. No.: WO2017/002629
PCT Pub. Date: Jan. 5, 2017

(65) Prior Publication Data

US 2018/0175552 A1 Jun. 21, 2018

(30) Foreign Application Priority Data

Jul. 2, 2015 (JP) ..... 2015-133446

(51) Int. Cl.
*H01R 13/639* (2006.01)
*H01R 27/02* (2006.01)
(Continued)

(52) U.S. Cl.
CPC ..... *H01R 13/639* (2013.01); *H01H 33/045* (2013.01); *H01H 33/121* (2013.01);
(Continued)

(58) Field of Classification Search
CPC ..... H01R 13/7031; H01R 13/7032; H01R 13/703; H01R 31/08; H01R 31/085
See application file for complete search history.

(56) References Cited

FOREIGN PATENT DOCUMENTS

| | | |
|---|---|---|
| JP | 2002-343506 | 11/2002 |
| JP | 2003-16880 | 1/2003 |
| JP | 2015-142107 | 8/2015 |

OTHER PUBLICATIONS

International Search Report dated Sep. 13, 2016.

*Primary Examiner* — Ross Gushi
(74) *Attorney, Agent, or Firm* — Gerald E. Hespos; Michael J. Porco; Matthew T. Hespos

(57) ABSTRACT

A service plug has a main connector (30 with two plate-like terminals (32) having coplanar plate surfaces, an accommodating portion (34) having the plate-like terminals (32) therein, and a first connecting portion (36, 38) having first connection terminals to connect the plate-like terminals (32) together by being inserted into the accommodating portion (34). A detection connector (40) includes a detection housing (44) with two detection terminals (42) inside. A second connecting portion (46) has a second connection terminal and is movable between an engaged position where the second connecting portion is engaged with the detection housing (44) and the second connection terminal connects the detection terminals (42) to each other and a non-engaged position where the second connecting portion does not engage the detection housing (44) by sliding within a width range of the first connecting portion (36, 38) along the surfaces of the plate-like terminals (32).

4 Claims, 12 Drawing Sheets

(51) Int. Cl.

| | |
|---|---|
| ***H01H 33/12*** | (2006.01) |
| ***H01R 13/71*** | (2006.01) |
| ***H01H 33/04*** | (2006.01) |
| ***H01R 13/04*** | (2006.01) |

(52) U.S. Cl.
CPC ..... *H01R 13/04* (2013.01); *H01R 13/71* (2013.01); *H01R 27/02* (2013.01)

SERVICE PLUG

BACKGROUND

Field of the Invention

A technique disclosed in this specification relates to a service plug.

Description of the Related Art

A known power supply circuit cut-off device (service plug) is used for cutting off power supply from a battery in a hybrid or electric vehicle. The service plug of this type normally includes two detection terminals and two main terminals in which a current from the battery flows. A relay circuit is turned off and a non-conductive state is set between the main terminals by disconnecting the detection terminals from each other. The main terminals then can be disconnected from each other. Thus, to ensure a switching time of the relay circuit, there needs to be a time lag until the main terminals are disconnected from each other after the detection terminals are disconnected from each other.

Japanese Unexamined Patent Publication No. 2015-142107 discloses a power supply circuit cut-off device of a lever fitting type in which the switching time of a relay circuit is ensured. The relay circuit disclosed in Japanese Unexamined Patent Publication No. 2015-142107 is turned on and a conductive state is set between two power terminals by connecting two detection terminals to each other and turning on a detection switch after the power terminals are connected to each other. Further, by disconnecting the detection terminals from each other and turning off the detection switch from this state, the relay circuit is turned off and power terminals can be disconnected from each other.

However, the power supply circuit cut-off device of the lever fitting type disclosed in Japanese Unexamined Patent Publication No. 2015-142107 includes a lever for relatively moving a connector provided with one power terminal to a connector provided with the other power terminal, and the two power terminals can be connected to or disconnected from each other by rotating this lever. Thus, a large space is necessary to rotate the lever.

This specification discloses a service plug that was created in view of the above problem and aims to realize space saving of a service plug.

SUMMARY

This specification is directed to a service plug in which a conductive state is set between two plate-like terminals by connecting two detection terminals to each other after the plate-like terminals are connected to each other. The service plug has a main connector including the plate-like terminals disposed such that plate surfaces thereof are located on the same plane. The service plug also includes an accommodating portion having the two plate-like terminals accommodated therein, and a first connecting portion having first connection terminals. The first connection terminals collectively sandwich the respective plate surfaces of the plate-like terminals and connect the plate-like terminals to each other by being inserted into the accommodating portion. The accommodating portion includes a locking portion, and the first connecting portion includes a locked portion configured to be locked to the locking portion with the first connecting portion inserted in the accommodating portion. The service plug further has a detection connector including a detection housing with the detection terminals disposed inside and a second connecting portion having a second connection terminal. The second connecting portion is disposed movably between an engaged position and a non-engaged position. The second connecting portion is engaged with the detection housing and the second connection terminal connects the two detection terminals to each other when the second connecting portion is in the engaged position. However, the second connecting portion is not engaged with the detection housing when the second connecting portion is in the non-engaged position. The second connecting portion is moved between the engaged position and the no-engaged position by being slid within a range of a width of the first connecting portion in a direction along the plate surfaces of the plate-like terminals. The detection connector is provided adjacent to the main connector.

In the above-described service plug, when the conductive state is set between the plate-like terminals, an operation of accommodating the first connecting portion into the accommodating portion and locking the locked portion to the locking portion and an operation of moving the second connecting portion to the engaged position after the former operation need to be performed in two steps. Thus, a time lag can be given between a connection timing of the plate-like terminals and a connection timing of the detection terminals and a switching time of a relay circuit can be ensured.

On the other hand, when a non-conductive state is set between the plate-like terminals, an operation of moving the second connecting portion to the non-engaged position and an operation of disengaging the locked portion from the locking portion after the former operation need to be performed in two steps to withdraw the first connecting portion from the accommodating portion. Thus, a time lag can be given between a disconnection timing of the detection terminals and a disconnection timing of the plate-like terminals and a switching time of a relay circuit can be ensured.

Further, the detection connector is provided adjacent to the main connector and the second connecting portion is slid within the range of the width of the first connecting portion in the direction along the plate surfaces of the plate-like terminals. Thus, the second connecting portion is moved while being held adjacent to the first connecting portion without moving beyond the range of the width of the first connecting portion in the direction along the plate surfaces. As a result, a movable range of the second connecting portion can be narrowed and space saving of the service plug can be realized, for example, as compared to a configuration in which a second connecting portion is a lever-type member and detection terminals are connected to or disconnected from each other by rotating this lever.

The first connecting portion may include a groove configured to support the second connecting portion slidably in the direction along the plate surfaces of the plate-like terminals. According to this configuration, it is possible to provide a specific structure for providing the detection connector adjacent to the main connector.

The second connecting portion may include a cover configured to cover the locking portion and the locked portion when the second connecting portion is moved to the engaged position and to cause the locking portion and the locked portion to be exposed when the second connecting portion is moved to the non-engaged position. According to this configuration, when the second connecting portion is at the engaged position, the locking portion and the locked portion are covered by the cover and the locked portion cannot be disengaged from the locking portion. Thus, when the non-conductive state is set between the plate-like terminals, the operation of disengaging the locked portion from the locking portion and the operation of moving the second connecting portion to the non-engaged position cannot be performed simultaneously. Thus, when a state between the plate-like terminals is switched from the conductive state to the non-conductive state, a time lag can be given more reliably between the disconnection timing of the detection terminals and the disconnection timing of the plate-like terminals.

According to the invention, it is possible to realize space saving of a service plug.

SUMMARY

A first embodiment is described with reference to FIGS. 1 to 10. A service plug 1, for example, in a hybrid or electric vehicle is illustrated in the first embodiment. Note that, in the following description, an upper side of FIGS. 1 to 4, 7 and 8 is referred to as an upper side of the service plug 1, a right-lower side of each perspective view and a right side of FIGS. 5 to 10 are referred to a right side of the service plug 1, and a left-lower side of each perspective view and a lower side of FIGS. 5, 6, 9 and 10 are referred to as a front side of the service plug 1.

Figure 1:
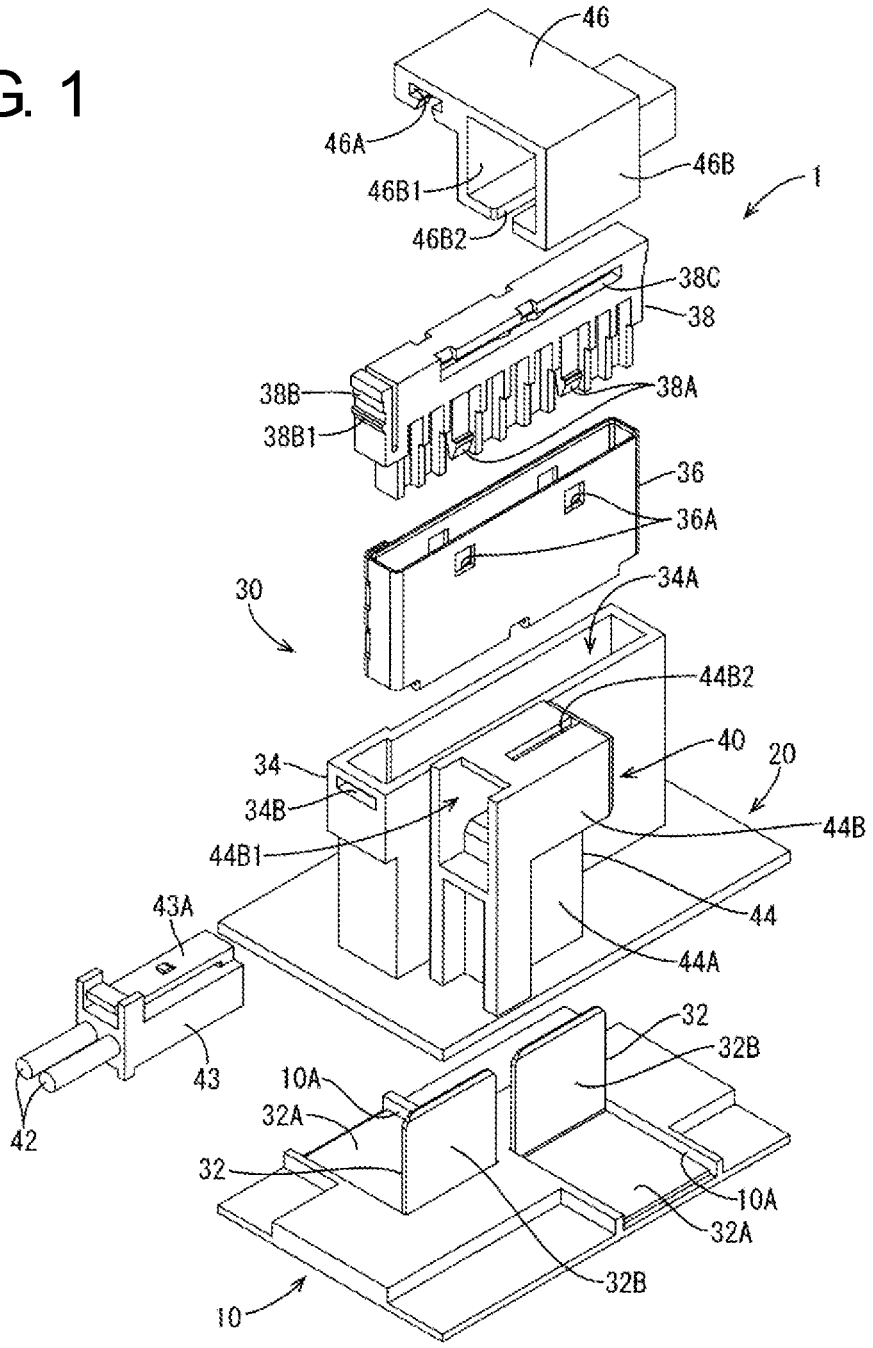
FIG. 1 is an exploded perspective view of a service plug according to a first embodiment.
Figure 3:
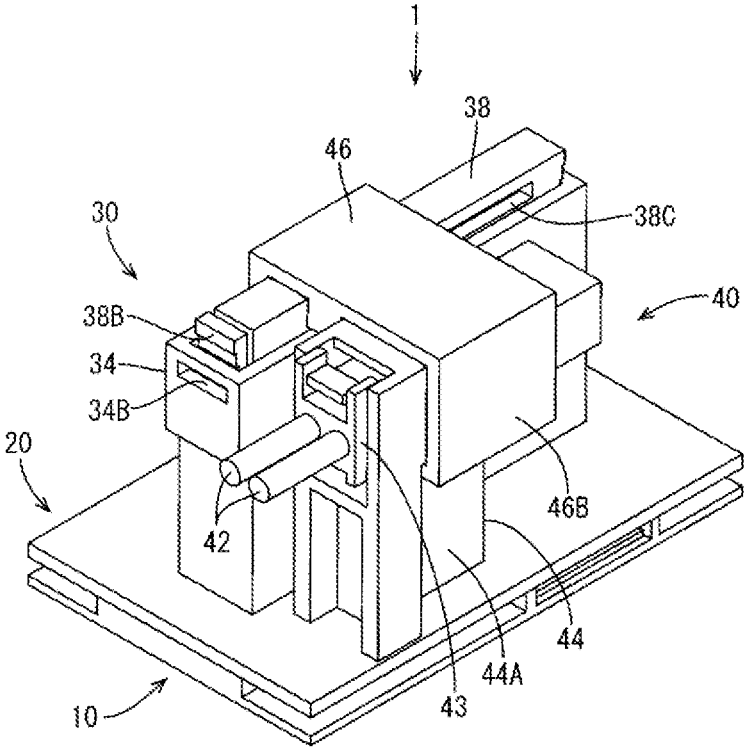
FIG. 3 is a perspective view of the service plug when a second connecting portion is at an engaged position.

As shown in FIGS. 1 and 3, the service plug 1 of this embodiment includes a lower case 10, an upper case 20, a main connector 30 and a detecting connector 40 and is configured by assembling the respective members with each other. The lower case 10 is, as shown in FIG. 1, a plate-like member made of synthetic resin and includes an arranging portion 10A on which two plate-like terminals 32 to be described later are arranged. The upper case 20 is a plate-like member made of synthetic resin and arranged to overlap the lower case 10. The upper case 20 includes an unillustrated opening, into which a rising portion of each plate-like terminal 32 is inserted, by the upper case 20 overlapping the lower case 10.

The main connector 30 includes the two plate-like terminals 32, a main housing (an example of an accommodating portion) 34, a main circuit terminal 36 and a housing 38. The main circuit terminal 36 and the housing 38 are an example of a first connecting portion. As shown in FIG. 1, each of the plate-like terminals 32 is composed of a flat plate 32A fixedly arranged on the arranging portion 10A of the lower case 10 and a flat plate-shaped rising portion 32B rising substantially at a right angle from one end part of the flat plate 32A. The plate-like terminals 32 are disposed such that the respective flat plates 32A extend in opposite lateral directions and plate surfaces of the respective rising portions 32B are located on the same plane with a tiny space defined therebetween.

The main housing 34 is made of synthetic resin and has a substantially rectangular tube shape long and narrow in a front-rear direction. The main housing 34 stands integrally on the upper case 20 such that a lower opening coincides with an opening provided in the upper case 20 in a vertical direction. The main circuit terminal 36 and the housing 38 are accommodated in an accommodation space 34A inside the main housing 34. Further, a locking portion 34B open in the front-rear direction and configured to lock a locked portion 38B of the housing 38 is provided on an upper side of the front surface of the main housing 34.

As shown in FIG. 1, the main circuit terminal 36 is formed by bending a thin plate-like metal material excellent in conductivity into a substantially rectangular tube shape and accommodated into the accommodation space 34A of the main housing 34 in such an orientation that a tube axis direction thereof coincides with the vertical direction. The main circuit terminal 36 is bent to have a size to surround the respective rising portions 32B of the plate-like terminals 32 exposed from the opening in the upper case 20 to the accommodation space 34A of the main housing 34. Locking holes 36A are provided on upper parts of both left and right side surfaces of the main circuit terminal 36 to lock with the housing 38.

Figure 7:
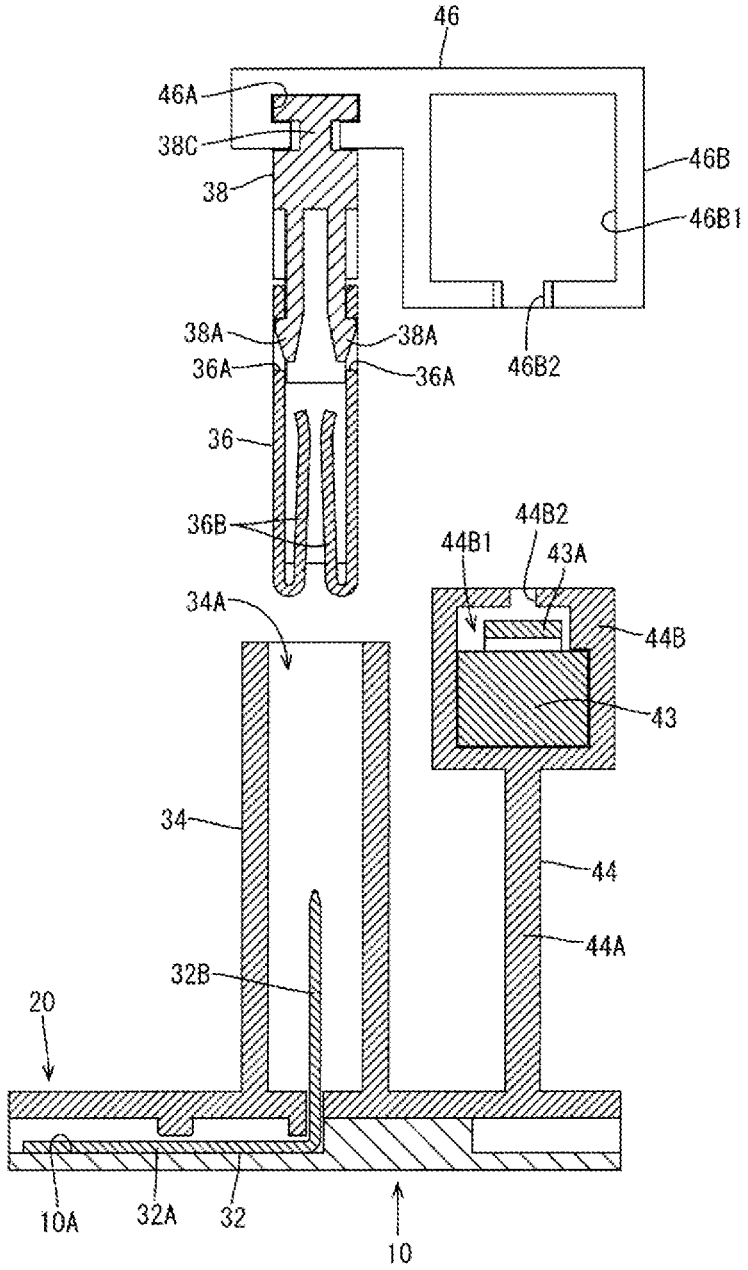
FIG. 7 is a section of the service plug showing the state before the assembly is inserted into the accommodating portion.
Figure 8:
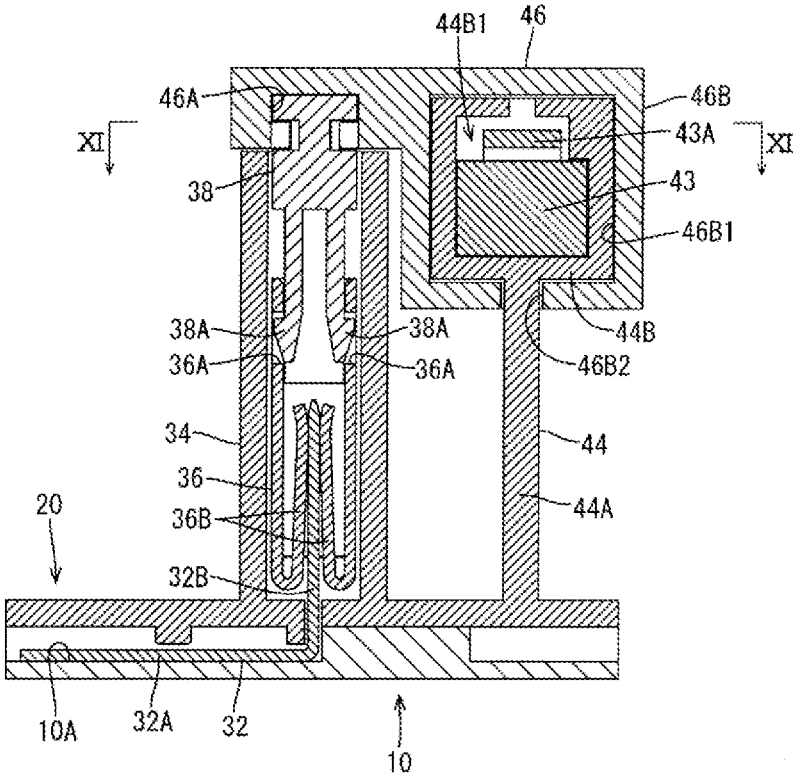
FIG. 8 is a section along VIII-VIII in FIG. 5 of the service plug showing a state after the assembly is inserted into the accommodating portion.

As shown in FIG. 7, lower end parts of both left and right side surfaces of the main circuit terminal 36 are folded inward to extend up and resiliently come closer to each other in the lateral direction inside the main circuit terminal 36. These inwardly folded parts serve as first connection terminals 36B to be connected to the plate-like terminals 32. When the main circuit terminal 36 is accommodated into the accommodation space 34A, the first connection terminals 36B collectively sandwich the respective rising portions 32B of the plate-like terminals 32, thereby connecting the plate-like terminals 32 to each other.

As shown in FIG. 1, the housing 38 is a block-shaped member made of synthetic resin, and a lower part thereof is mounted into an upper part of the main circuit terminal 36 to close an upper opening of the main circuit terminal 36. Specifically, claws 38A to be locked to the respective locking holes 36A of the main circuit terminal 36 are provided on both left and right sides of the housing 38. Each claw 38A is formed of a resilient piece having an outward facing claw on a lower end part thereof. This claw is inserted into the locking hole 36A of the main circuit terminal 36 to be hooked thereto, thereby being locked to the locking hole 36A (see FIGS. 2 and 8).

As shown in FIG. 1, the locked portion 38B to be locked by the locking portion 34B of the main housing 34 is provided on a front end part of the housing 38. The locked portion 38B is formed of a resilient piece extending up, and a hook 38B1 provided on a part of the locked portion 38B is inserted into an opening of the locking portion 34B to be hooked thereto, thereby being locked by the locking portion 34B.

Figure 9:
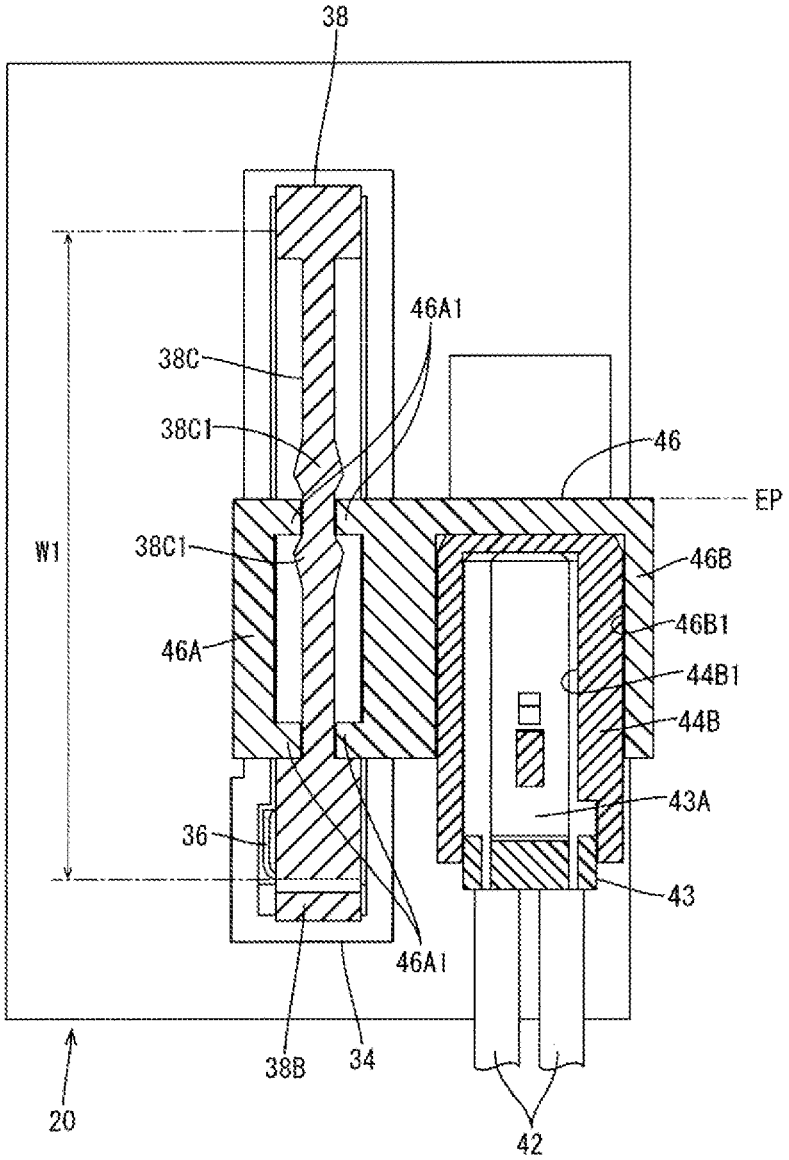
FIG. 9 is a lateral section along XI-XI in FIG. 8 of the service plug when the second connecting portion is at the engaged position.

As shown in FIGS. 1 and 9, grooves 38C open in both left and right sides of the housing 38 and extending along the front-rear direction are provided on both left and right sides of an upper part of the housing 38. A second connecting portion 46 to be described later is supported slidably in the grooves 38C. Positioning portions 38C1 are provided in bottom parts of the grooves 38C by slightly bulging outward (toward both left and right sides) (see FIGS. 9 and 10). The positioning portions 38C1 position the second connecting portion 46 slidably in the front-rear direction at an engaged position and a non-engaged position to be described later.

Figure 5:
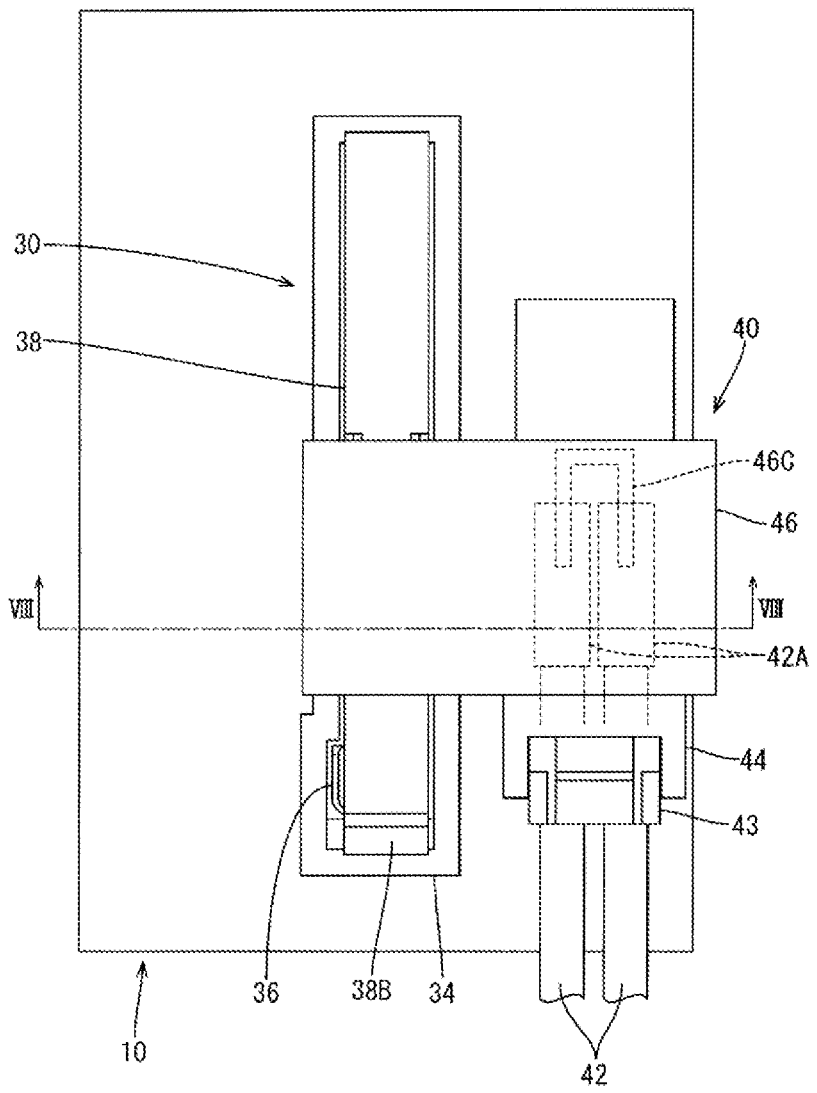
FIG. 5 is a plan view of the service plug viewed from above when the second is at the engaged position.

The detection connector 40 is provided adjacent to the main connector 30 and includes, as shown in FIG. 1, two detection terminals 42, a detection housing 44 and the second connecting portion 46. Front parts of the detection terminals 42 extend forward for connection to an unillustrated relay circuit, and a connector 43 is mounted on rear parts thereof. The connector 43 is made of synthetic resin and has a box shape long in the front-rear direction. A resilient locking lance 43A with a protrusion is provided on an upper part of the connector 43. As shown in FIG. 5, connection plugs 42A of a female terminal are mounted on rear end parts of the detection terminals 42 located inside the connector 43.

The detection housing 44 is made of synthetic resin and is integral with the upper case 20. As shown in FIG. 1, the detection housing 44 stands on the upper case 20 at a position near the main housing 34 of the main connector 30 on a right side of the main housing 34. The detection housing 44 is composed of a wall 44A rising from the upper case 20 with a wall surface facing in the lateral direction and a fixing portion 44B is provided on the wall 44A. A height of the detection housing 44 is slightly larger than that of the main housing 34, as shown in FIG. 7.

Figure 6:
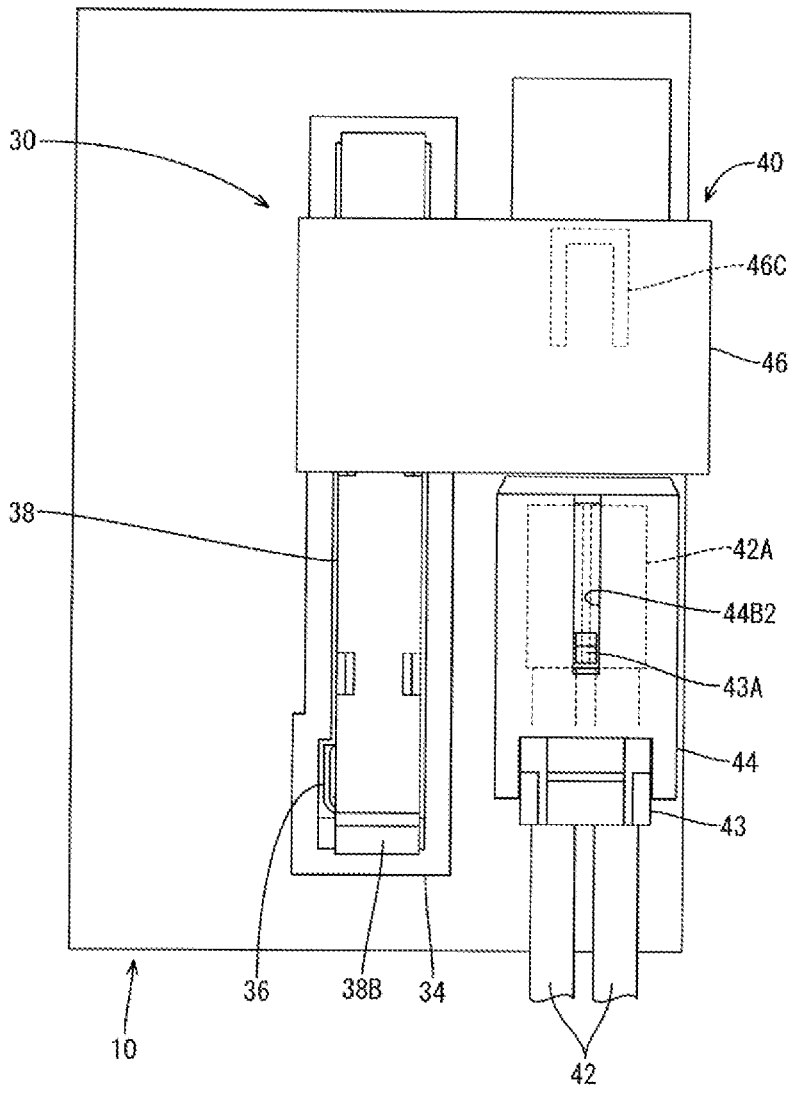
FIG. 6 is a plan view of the service plug viewed from above when the second connecting portion is at the non-engaged position.

The fixing portion 44B is open on both front and rear sides, and the connector 43 of the detection terminals 42 is accommodated and fixed in an internal space 44B1 of the fixing portion 44B. As shown in FIGS. 1 and 6, a slit 44B2 vertically penetrates the upper surface of the fixing portion 44B and extends in the front-rear direction. The connector 43 is accommodated into the internal space 44B1 through a front opening of the fixing portion 44B. At this time, the locking lance 43A of the connector 43 is deformed resiliently and the protrusion of the locking lance 43A is locked to the slit 44B2 to fix the connector 43 in the internal space 44B1.

The second connecting portion 46 is made of synthetic resin and, as shown in FIG. 1, is disposed on an uppermost side in the service plug 1. A sandwiching portion 46A is provided on a left part of the second connecting portion 46 and includes a downwardly open groove extending in the front-rear direction. The sandwiching portion 46 is to be attached to the grooves 38C to sandwich the grooves 38C of the housing 38 from both left and right sides.

Figure 4:
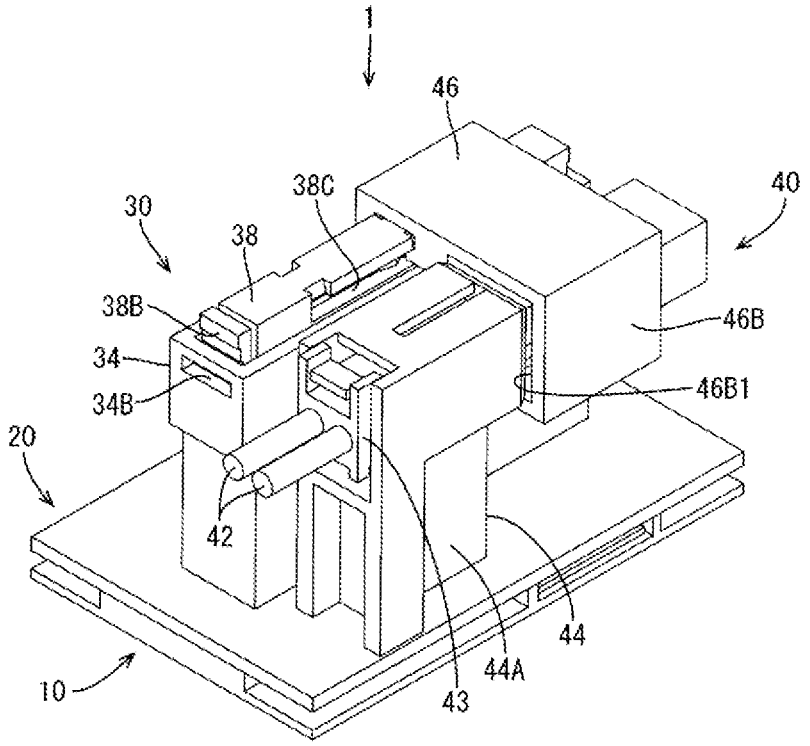
FIG. 4 is a perspective view of the service plug when the second connecting portion is at a non-engaged position.

By attaching the sandwiching portion 46A to the grooves 38C of the housing 38, the second connecting portion 46 is supported slidably in the front-rear direction along the grooves 38C within a range of a width W1 (see FIG. 9) in the front-rear direction of the main circuit terminal 36 having the housing 38 mounted therein, i.e. in a direction along the plate surfaces of the rising portions 32B of the plate-like terminals 32 (see FIGS. 3 and 4).

Figure 10:
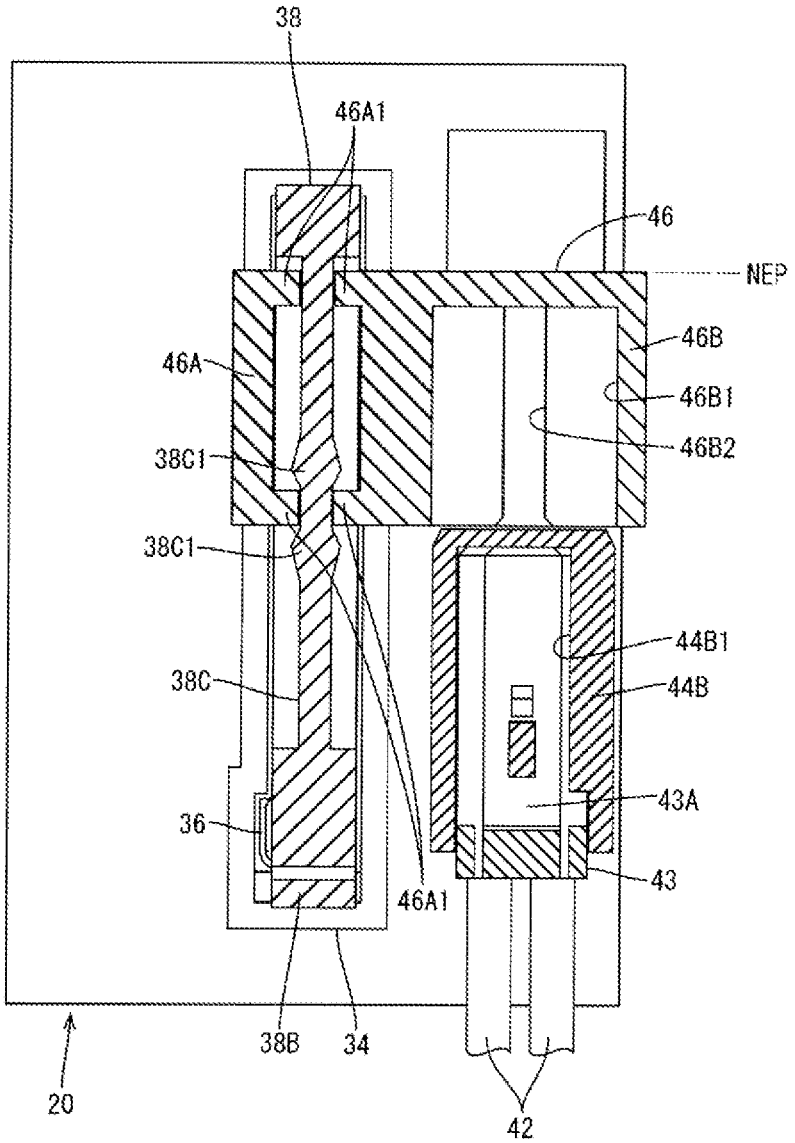
FIG. 10 is a lateral section of the service plug when the second connecting portion is at the non-engaged position.

As shown in FIGS. 9 and 10, projections 46A1 project into the grooves 38C from both left and right sides with the sandwiching portion 46A attached to the grooves 38C being provided on both front and rear end parts of the sandwiching portion 36A. The second connecting portion 46 is slid in the front-rear direction and positioned so that either the projections 46A1 provided on a front end part of the sandwiching portion 46A or the projections 46A1 provided on a rear end part of the sandwiching portion 46A are inserted between the positioning portions 38C1 in the grooves 38C.

As shown in FIG. 1, a fitting 46B is provided on a right part of the second connecting portion 46 and is to be fit to the fixing portion 44B of the detection housing 44. The fitting 46B is open forward and a fitting space 46B1 inside is one size larger than the fixing portion 44B. A forwardly open slit 46B2 vertically penetrates a lower side of the fitting portion 46B and extends in the front-rear direction.

A width of the slit 4662 is larger than a thickness of the wall 44A of the detection housing 44. The wall 44A of the detection housing 44 is inserted into the slit 4662 of the fitting 46B when the fixing portion 44B is inserted through a front opening of the fitting 46B and into the fitting space 46B1 (see FIG. 8). Thus, the second connecting portion 46 can be moved in the front-rear direction with the fixing portion 44B inserted in the fitting space 4661. The fitting portion 46B is fit to the fixing portion 44B by inserting the fixing portion 44B to a back part of the fitting space 4661.

As shown in FIG. 6, a second connecting terminal 46C of a male terminal type substantially U-shaped in a plan view is disposed in the back part of the fitting space 46B1 of the fitting 46B. When the fixing portion 44B is inserted to the back part of the fitting space 46B1 with the connector 43 fixed in the internal space 44B1 of the fixing portion 44B, the respective connection plugs 42A of the detection terminals 42 are mated with the second connection terminal 46C, thereby connecting the detection terminals 42 and the second connection terminal 46C.

Specifically, by sliding the second connecting portion 46 forward, the respective projections 46A1 provided on the rear end part of the sandwiching portion 46A are inserted between the positioning portions 38C1 in the grooves 38C to position the second connecting portion 46, as shown in FIG. 9. In this state, the fitting portion 46B of the second connecting portion 46 is fit to the fixing portion 44B of the detection housing 44 and the second connecting terminal 46C connects the two detection terminals 42. The position of the second connecting portion 46 in this state (state shown in FIG. 9) is referred to as an engaged position EP below.

On the other hand, by sliding the second connecting portion 46 rearward from the state shown in FIG. 9, the respective projections 46A1 provided on the front end part of the sandwiching portion 46A are inserted between the positioning portions 38C1 in the grooves 38C to position the second connecting portion 46, as shown in FIG. 10. In this state, the fitting 46B of the second connecting portion 46 is separated from the fixing portion 44B of the detection housing 44 and the second connection terminal 46C and the two detection terminals 42 are disconnected. The position of the second connecting portion 46 in this state (state shown in FIG. 10) is referred to as a non-engaged position NEP. As just described, the second connecting portion 46 is disposed movably between the engaged position EP and the non-engaged position NEP.

Figure 2:
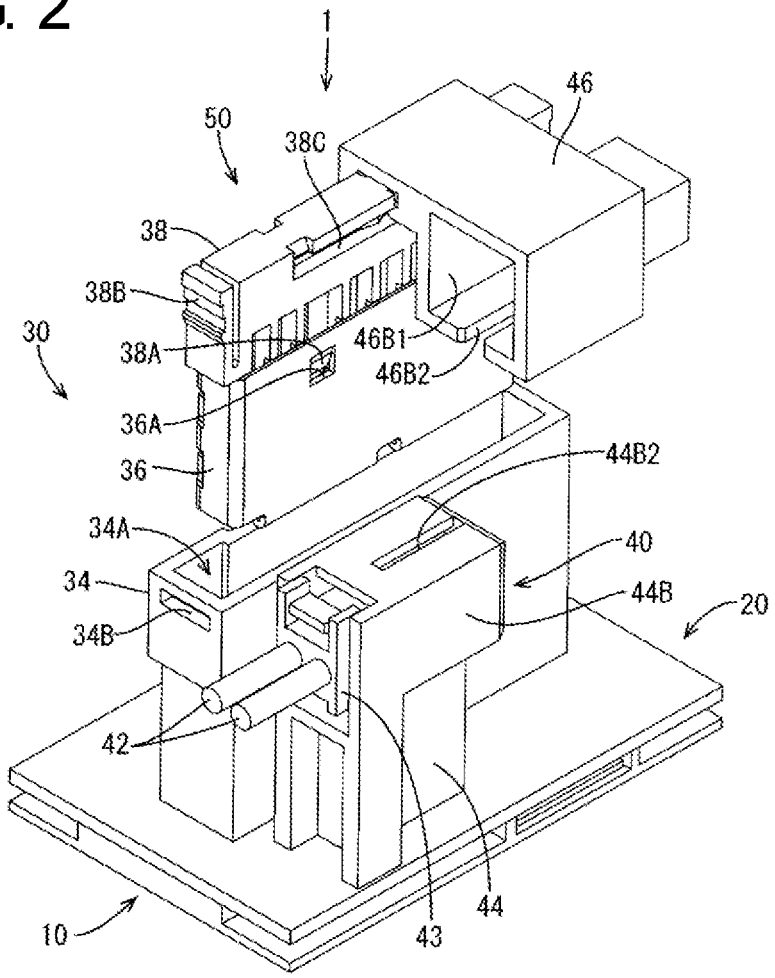
FIG. 2 is a perspective view of the service plug showing a state before an assembly is inserted into an accommodating portion.

Each member of the service plug 1 configured as described above can be assembled, for example, as follows. Specifically, as shown in FIG. 2, the main circuit terminal 36 and the housing 38 are assembled and the sandwiching portion 46A of the second connecting portion 46 is mounted in the grooves 38C of the housing 38, thereby forming an assembly 50. Further, as shown in FIG. 2, the connector 43 mounted on the detection terminals 42 is accommodated and fixed in the internal space 44B1 of the fixing portion 44B of the detection housing 44.

Next, a procedure of switching a state between the pair of plate-like terminals 32 from a non-conducive state to a conductive state in the service plug 1 shown in FIG. 2 is described. First, the second connecting portion 46 in the assembly 50 is slid to a rear end in advance. Then, the main circuit terminal 36 of the assembly 50 is accommodated into the accommodation space 34A inside the main housing 34 and the locked portion 38B is locked to the locking portion 34B so that the respective rising portions 32B of the two plate-like terminals 32 are sandwiched collectively by the first connection terminals 36B. In this way, the two plate-like terminals 32 are connected to each other and the second connecting portion 46 is located behind the fixing portion 44B of the detection housing 44 (see FIG. 6).

Subsequently, the second connecting portion 46 is slid forward to reach the engaged position EP. In this way, the fixing portion 44B of the detection housing 44 is inserted into the fitting 46B of the second connecting portion 46 and the sandwiching portion 46A of the second connecting portion 46 is positioned so that the fitting portion 46B is fit to the fixing portion 44B (see FIG. 5). As a result, the two detection terminals 42 are connected to each other by the second connection terminal 46C, the relay circuit is turned on and the conductive state is set between the two plate-like terminals 32.

Next, a procedure of setting the non-conductive state between the plate-like terminals 32 set in the conductive state by the above procedure in the service plug 1 shown in FIG. 2 is described. First, the second connecting portion 46 in the assembly 50 is slid rearward to reach the non-engaged position NEP. In this way, the fixing portion 44B of the second connecting portion 46 is separated from the fitting 46B of the detection housing 44 and the sandwiching portion 46A of the second connecting portion 46 is positioned (FIG. 6). As a result, the two detection terminals 42 are disconnected from each other, the relay circuit is turned off and the non-conductive state is set between the two plate-like terminals 32.

Thereafter, the locked portion 38B is disengaged from the locking portion 34B and the main circuit terminal 36 is withdrawn from the accommodation space 34A inside the main housing 34 so that the two plate-like terminals 32 can be disconnected from each other. As described above, there is a time lag between a connection timing of the plate-like terminals 32 and a connection timing of the detection terminals 42 (on-timing of the relay circuit) and between a disconnection timing of the detection terminals 42 and a disconnection timing of the plate-like terminals 32 (off-timing of the relay circuit) so that a switching time of the relay circuit can be ensured.

In the service plug 1 of this embodiment, the detection connector 40 is provided adjacent to the main connector 30 and the second connecting portion 46 is slid in the front-rear direction within the range of the width W1 of the main circuit terminal 36. Thus, the second connecting portion 46 is moved while being held adjacent to the main circuit terminal 36 without moving beyond the range of the width W1 of the main circuit terminal 36 in the front-rear direction. As a result, a movable range of the second connecting portion 46 can be narrowed and space saving of the service plug can be realized, for example, as compared to a configuration in which a second connecting portion is a lever-type member and two detection terminals are connected to or disconnected from each other by rotating this lever.

If a time until the conductive state is set after the two plate-like terminals 32 are connected to each other is short, an arc discharge may occur when the plate-like terminals 32 are sandwiched by the main circuit terminal 36. Further, if a time until the non-conductive state is set after the two plate-like terminals 32 are disconnected from each other is short, an arc discharge may occur when the two plate-like terminals 32 are withdrawn from the main circuit terminal 36.

In contrast, in the service plug 1 of this embodiment, the detection terminals for setting the conductive state or non-conductive state between the plate-like terminals 32 are provided besides the plate-like terminals 32 and there is a time lag between the connection timing of the plate-like terminals 32 and the connection timing of the detection terminals 42 and between the disconnection timing of the detection terminals 42 and the disconnection timing of the plate-like terminals 32. Thus, the occurrence of an arc discharge as described above can be suppressed.

<Second Embodiment>

Figure 11:
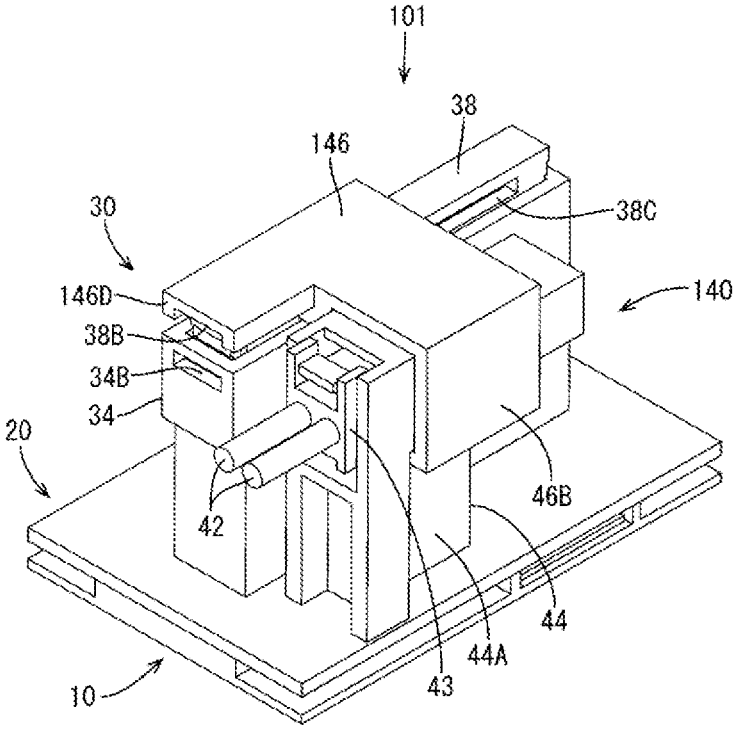
FIG. 11 is a perspective view of a service plug according to a second embodiment when a second connecting portion is at an engaged position.

A second embodiment is described with reference to FIGS. 11 and 12. A service plug 101 of this embodiment partially differs from that of the first embodiment in the configuration of a second connecting portion 146. Since the other configuration is as in the first embodiment, structures, functions and effects thereof are not described.

In the service plug 101 according to the second embodiment, a front end part of a left part of the second connecting portion 146 in a detection connector 140, i.e. of a part slidably supported on a housing 38, extends farther forward than that of the first embodiment. As shown in FIG. 11, this forward extending part covers a locked portion 38B of the housing 38 with the second connecting portion 146 supported on the housing 38 slid to an engaged position. The forward extending part in the second connecting portion 146 is referred to as a cover 146D below.

Figure 12:
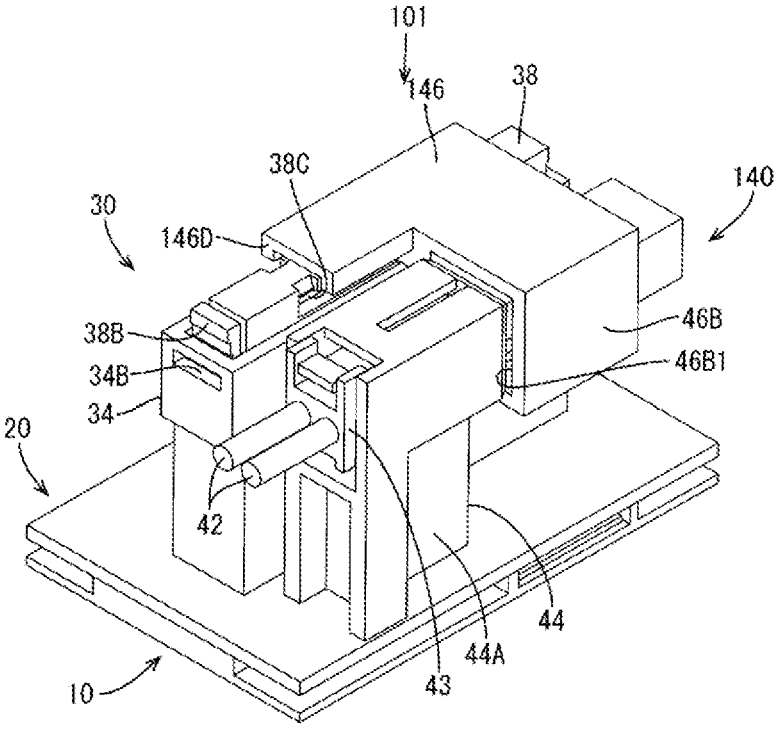
FIG. 12 is a perspective view of the service plug according to the second embodiment when the second connecting portion is at a non-engaged position.

On the other hand, as shown in FIG. 12, the locked portion 38B of the housing 38 is exposed from the cover 146D with the second connecting portion 146 supported on the housing 38 slid to a non-engaged position.

In the service plug 101 of this embodiment configured as described above, it can be suppressed that a sliding operation of the second connecting portion 146 and a withdrawing operation of a main circuit terminal 36 are simultaneously performed when a state between two plate-like terminals 32 is switched from a conductive state to a non-conductive state. Specifically, since the locked portion 38B is covered by the cover 146D of the second connecting portion 146 with the second connecting portion 146 slid to the engaged position, the locked portion 38B cannot be disengaged from the locking portion 34B while the second connecting portion 146 is slid to the non-engaged position and the operation of withdrawing the main circuit terminal 36 from an accommodation space 34A of a main housing 34 is suppressed.

Thus, when the state between the two plate-like terminals is switched from the conductive state to the non-conductive state, a time lag can be reliably given between a disconnection timing of the detection terminals and a disconnection timing of the plate-like terminals and the occurrence of an arc discharge can be suppressed.

Modifications of the above respective embodiments are listed below.

The second connecting portion is illustrated to be slidably supported on the housing in the above respective embodiments. However, the second connecting portion may be supported slidably on the main housing. In this case, the second connecting portion slid to the non-engaged position may not be located above the main circuit terminal (housing portion) to make connection terminals withdrawable from the main connector when the second connecting portion is slid to the non-engaged position.

The second connecting portion is illustrated to be positioned at the engaged position and the non-engaged position by the respective projecting portions provided in the grooves in the above respective embodiments. However, the configuration for positioning the slidable second connecting portion is not limited. Further, there may be no configuration for positioning the slidable second connecting portion.

The housing on which the second connecting portion is supported slidably and the main circuit terminal accommodated into the main connector are illustrated to be separate in the above respective embodiments. However, a member on which the second connecting portion is supported slidably and a member to be accommodated into the main connector may be integral.

Although the respective embodiments have been described in detail above, these are merely illustrative and not intended to limit the scope of claims. The structure described in claims includes various modifications and changes of the specific embodiments illustrated above.

LIST OF REFERENCE SIGNS

1, 101 . . . service plug
10 . . . lower case
20 . . . upper case
30 . . . main connector
32 . . . plate-like terminals
32A . . . flat plate portion
32B . . . rising portion
34 . . . main housing
34A . . . accommodation space
34B . . . locking portion
36 . . . main circuit terminal
36A . . . locking hole
36B . . . first connection terminal
38 . . . housing
38A . . . claw
38B . . . locked portion
38C . . . groove
40 . . . detection connector
42 . . . detection terminals
43 . . . connector
44 . . . detection housing
44A . . . wall
44B . . . fixing portion
46, 146 . . . second connecting portion
46A . . . sandwiching portion
46B . . . fitting
46C . . . second connection terminal
146D . . . cover
EP . . . engaged position
NEP . . . non-engaged position
W1 . . . width (of first connecting portion in front-rear direction)

The invention claimed is:

1. A service plug in which a conductive state is set between two plate-like terminals by connecting two detection terminals to each other after the two plate-like terminals are connected to each other, comprising:

a main connector including the two plate-like terminals disposed such that plate surfaces thereof are located on the same plane, an accommodating portion having the two plate-like terminals accommodated therein, and a first connecting portion having first connection terminals and configured such that the first connection terminals collectively sandwich the respective plate surfaces of the two plate-like terminals and connect the two plate-like terminals to each other by being inserted into the accommodating portion, the accommodating portion including a locking portion, the first connecting portion including a locked portion configured to make the first connecting portion non-withdrawable from the accommodating portion by being locked to the locking portion with the first connecting portion inserted in the accommodating portion; and a detection connector including a detection housing having the two detection terminals disposed inside and a second connecting portion having a second connection terminal and disposed movably between an engaged position where the second connecting portion is engaged with the detection housing and the second connection terminal connects the two detection terminals to each other and a non-engaged position where the second connecting portion is not engaged with the detection housing by being slid within a range of a width of the first connecting portion in a direction along the plate surfaces of the two plate-like terminals, the detection connector being provided adjacent to the main connector.

2. The service plug of claim 1, wherein the first connecting portion includes a groove configured to support the second connecting portion slidably in the direction along the plate surfaces of the two plate-like terminals.

3. The service plug of claim 2, wherein the second connecting portion includes a cover configured to cover the locking portion and the locked portion when the second connecting portion is moved to the engaged position and cause the locking portion and the locked portion to be exposed when the second connecting portion is moved to the non-engaged position.

4. The service plug of claim 1, wherein the second connecting portion includes a cover configured to cover the locking portion and the locked portion when the second connecting portion is moved to the engaged position and cause the locking portion and the locked portion to be exposed when the second connecting portion is moved to the non-engaged position.

* * * * *